US010102787B2

(12) United States Patent
Miura

(10) Patent No.: US 10,102,787 B2
(45) Date of Patent: Oct. 16, 2018

(54) IMAGE SIGNAL PROCESSING APPARATUS AND CONTROL METHOD THEREFOR

(71) Applicant: CANON KABUSHIKI KAISHA, Tokyo (JP)

(72) Inventor: Hiroya Miura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 422 days.

(21) Appl. No.: 14/558,460

(22) Filed: Dec. 2, 2014

(65) Prior Publication Data

US 2015/0154903 A1 Jun. 4, 2015

(30) Foreign Application Priority Data

Dec. 4, 2013 (JP) ..... 2013-251415

(51) Int. Cl.
*G09G 5/10* (2006.01)
*G09G 3/20* (2006.01)

(52) U.S. Cl.
CPC ... *G09G 3/2003* (2013.01); *G09G 2320/0233* (2013.01); *G09G 2320/0242* (2013.01)

(58) Field of Classification Search
CPC ..... G09G 3/2003; G09G 2320/0233; G09G 2320/0242
See application file for complete search history.

(56) References Cited

U.S. PATENT DOCUMENTS

2004/0130625 A1* 7/2004 Imamura ..... H04N 17/02 348/185
2006/0082565 A1* 4/2006 Saito ..... G09G 3/00 345/204
2010/0118044 A1* 5/2010 Ishihara ..... G09G 3/20 345/589
2011/0063332 A1* 3/2011 Liao ..... G09G 3/003 345/690
2012/0050561 A1* 3/2012 Kitajima ..... G06F 17/30265 348/222.1
2012/0288191 A1* 11/2012 Kido ..... G06K 9/4652 382/165
2013/0127924 A1* 5/2013 Lee ..... G09G 3/32 345/690
2013/0215360 A1* 8/2013 Pollack ..... G09G 3/3413 349/61

FOREIGN PATENT DOCUMENTS

JP 4181625 B 11/2008
WO 2009/075027 A1 6/2009

* cited by examiner

*Primary Examiner* — Towfiq Elahi
(74) *Attorney, Agent, or Firm* — Cowan, Liebowitz & Latman, P.C.

(57) ABSTRACT

Disclosed is an image signal processing apparatus with a function to display an image signal and a luminance waveform representing a relationship between a luminance level and a position in the image signal. The apparatus displays the image signal such that a predetermined color is applied to an area whose luminance level falls within a preset luminance level range. On the other hand, the luminance waveform of the image signal is displayed such that a color corresponding to the predetermined color is applied to an area corresponding to the luminance level range.

18 Claims, 6 Drawing Sheets

IMAGE SIGNAL PROCESSING APPARATUS AND CONTROL METHOD THEREFOR

BACKGROUND OF THE INVENTION

Field of the Invention

The present invention relates to an image signal processing apparatus and a control method therefor.

Description of the Related Art

Conventionally, as a function to assist in setting exposure conditions at the time of image capture on a device provided with an image capture function, a function to display the levels and distribution of luminances of pixels composing an image is known. For example, a function to display a zebra pattern superimposed over pixels with luminance levels in a predetermined range, and to display pixels of a particular color as replacements (false color display), is known (Japanese Patent No. 4181625).

A display method called a waveform monitor is also known, in which luminances located in a direction of vertical lines (or horizontal lines) on a screen and the appearance frequencies thereof are indicated by display positions of a waveform and luminance levels thereof.

False color display is effective in finding out positions and a range in which pixels with luminance levels in a predetermined range exist, but makes it difficult to grasp the correspondence between display colors and specific luminance levels. Meanwhile, experience is necessary in understanding a relationship between waveform monitor display and an image, and a relationship between luminance levels of a waveform and positions in the image has been unclear.

SUMMARY OF THE INVENTION

The present invention has been made in view of the aforementioned problems of conventional techniques, and provides an image signal processing apparatus and a control method therefor that realize display with which a portion of an image that has a predetermined luminance level range, as well as specific values of the predetermined luminance level range, is easily understandable.

According to one aspect of the present invention, there is provided an image signal processing apparatus comprising a display control unit that displays an image signal such that a first area whose luminance level falls within a preset luminance level range is displayed in a predetermined color, and displays a luminance waveform representing a relationship between a luminance level and a position in the image signal such that a second area corresponding to the preset luminance level range is displayed in a color corresponding to the predetermined color.

According to another aspect of the present invention, there is provided a control method for an image signal processing apparatus, the control method comprising: a step of displaying an image signal such that an area whose luminance level falls within a preset luminance level range is displayed in a predetermined color; and a step of displaying a luminance waveform representing a relationship between a luminance level and a position in the image signal such that an area corresponding to the luminance level range is displayed in a color corresponding to the predetermined color.

Further features of the present invention will become apparent from the following description of exemplary embodiments with reference to the attached drawings.

DESCRIPTION OF THE EMBODIMENTS

Exemplary embodiments of the present invention will now be described in detail in accordance with the accompanying drawings.

The following describes a case in which the present invention is applied to a digital camera. However, the present invention is applicable to any apparatus with a function to process and display an image signal. Therefore, an image signal processing apparatus according to embodiments of the present invention covers, for example, the following apparatuses: an image capture apparatus (e.g., a digital video camera and a digital still camera), and an electronic device with an image capture function (e.g., a mobile information terminal provided with a camera, a mobile telephone provided with a camera, and a personal computer provided with a camera). As an image capture function is not essential, the image signal processing apparatus also covers apparatuses and devices that are generally called image processing apparatuses, from various types of picture monitors, master monitors, and waveform monitors to personal computers and the like.

First Embodiment

Figure 1:
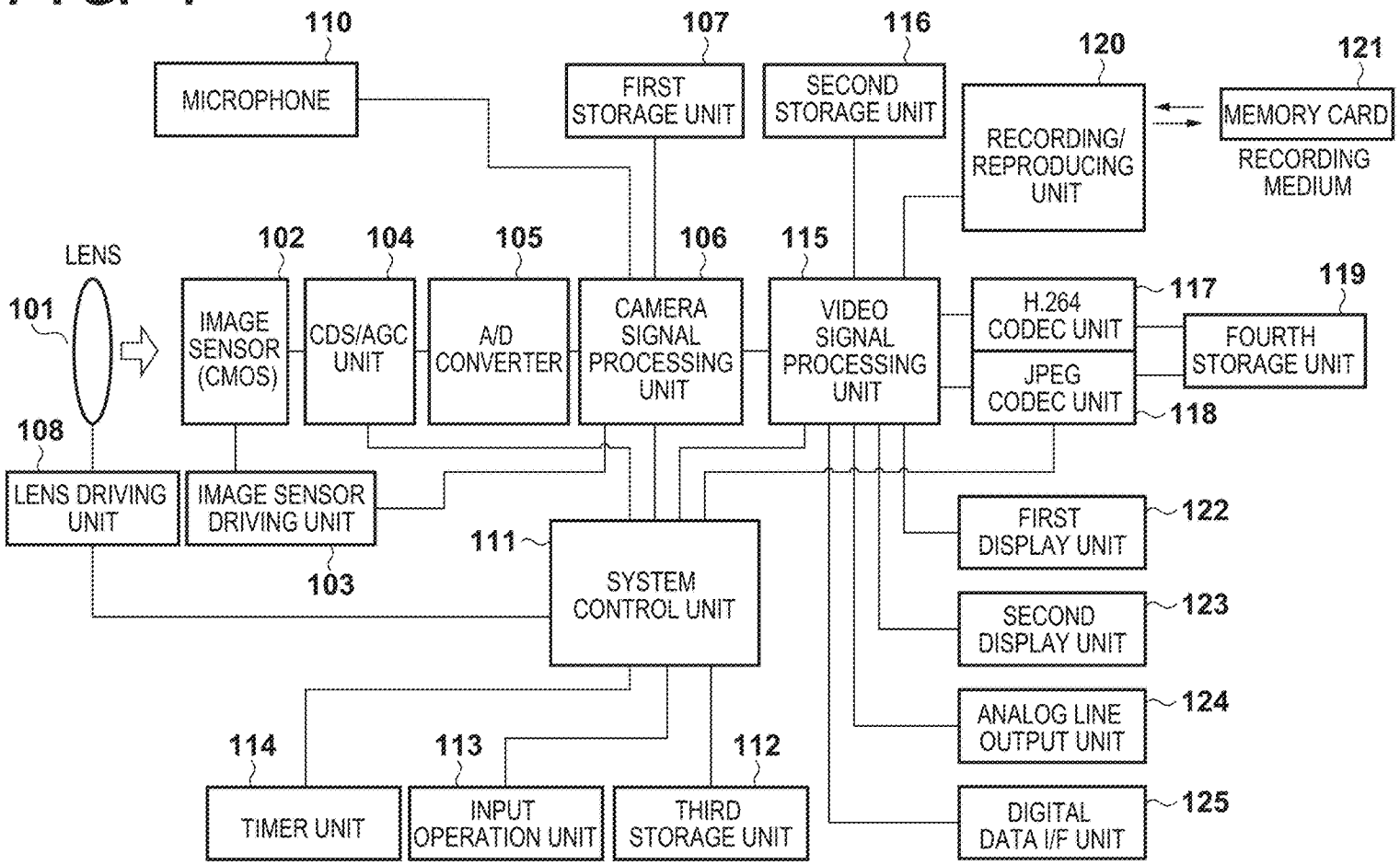
FIG. 1 is a block diagram showing an example of a functional configuration of a digital camera, which is one example of an image processing apparatus according to an embodiment of the present invention.

FIG. 1 is a functional block diagram of a digital camera according to the present embodiment. A lens unit 101 constitutes an optical system that forms a subject image on an image surface of an image sensor 102, and has a zoom function, a focus adjustment function, and a diaphragm adjustment function that enable manual operations by a user. The image sensor 102 is composed of a large number of photoelectric conversion elements that are two-dimensionally arrayed therein, and converts an optical image of a subject formed by the lens unit 101 into a pixel-by-pixel image signal. The image sensor 102 may be, for example, a CMOS (Complementary Metal Oxide Semiconductor) image sensor or a CCD (Charged Coupled Device) image sensor. The image sensor 102 also has an electronic shutter function realized through adjustment of a charge accumulation period by the photoelectric conversion elements.

An image sensor driving unit 103 drives and controls the image sensor 102 in accordance with a timing controlled by a camera signal processing unit 106. A CDS/AGC unit 104 reduces noise by applying correlated double sampling (CDS) to an analog image signal from the image sensor 102, and applies gain control (AGC) to a signal level in accordance with control by a system control unit 111. An A/D (Analog to Digital) converter 105 converts an analog image signal from the CDS/AGC unit 104 into a digital image signal, and supplies the digital image signal to the camera signal processing unit 106.

In coordination with the system control unit 111, the camera signal processing unit 106 performs control of a camera image capture system, such as generation of a timing signal, automatic exposure (AE) control, gamma adjustment, and autofocus (AF) control.

The digital camera according to the present embodiment includes a first storage unit 107, a second storage unit 116, a third storage unit 112, and a fourth storage unit 119 for different uses. For convenience, the first storage unit 107, the second storage unit 116, the third storage unit 112, and the fourth storage unit 119 are described herein as being provided separately for camera signal processing, video control, system control, and coding/decoding, respectively; however, they may be physically realized by the same storage apparatus. The first to fourth storage units 107, 116, 112, 119 are typically constituted by readable and writable semiconductor memories; however, at least one of them may be constituted by another type of storage apparatus.

The camera signal processing unit 106 uses the first storage unit 107 as, for example, a frame memory in applying signal processing to a captured image. In accordance with control by the system control unit 111, a lens driving unit 108 drives, for example, a motor and an actuator, not shown, of the lens unit 101, changes positions of a magnification changing lens and a focusing lens, and performs an operation of opening and closing a diaphragm. In this way, the system control unit 111 can change a zoom ratio, adjust a focus distance, and adjust exposure for the lens unit 101. The lens driving unit 108 is controlled by the system control unit 111 based on the result of signal processing by the camera signal processing unit 106. For example, at the time of AF control, the system control unit 111 causes the lens unit 101 to focus on the subject by driving and controlling the focusing lens of the lens unit 101 through control of the lens driving unit 108 based on an AF evaluation value obtained by the camera signal processing unit 106.

A microphone 110 is enabled in recording ambient sound, and a sound signal from the microphone 110 is supplied to the camera signal processing unit 106. For example, in a case where sound from the microphone 110 is recorded together with an image captured by the image sensor 102, the camera signal processing unit 106 supplies the sound and image to a video signal processing unit 115 in such a manner that the sound and image match each other in terms of time.

The system control unit 111 is, for example, a programmable processor such as a CPU, and controls general operations of the digital camera according to the present embodiment by executing a program stored in the third storage unit 112. The third storage unit 112 includes, for example, a ROM and a RAM, and stores a program executed by the system control unit 111, various types of settings, default values, and the like. The third storage unit 112 is also used as a working area for the system control unit 111.

An input operation unit 113 is a user interface with which an operator issues an instruction to the digital camera, and includes input devices such as keys and various types of operation buttons.

A timer unit 114 includes a real-time clock (RTC) and a backup battery, and returns date/time information in response to a request from the system control unit 111.

The video signal processing unit 115 performs, for example, display control for a first display unit 122 and a second display unit 123, including adjustment of hue, saturation, and brightness, output control for an analog line output unit 124, output control for a digital data I/F unit 125, and control for a recording/reproducing unit 120. The video signal processing unit 115 also performs other operations, e.g., conversion of resolution of an image signal to various image output systems, including the first display unit 122 and the second display unit 123, and superimposition of a zebra pattern. The video signal processing unit 115 further controls OSD (On Screen Display), such as display of image capture information, user setting menus, and function buttons necessary for touchscreen operations. The second storage unit 116 is a storage unit for video control, and is used by the video signal processing unit 115 as a frame memory, a working memory, and the like in executing signal processing related to a video baseband signal.

An H.264 codec unit 117 is one example of a moving image codec that applies coding/decoding processing to moving images. A coding/decoding format thereof may be an MPEG (Moving Picture Experts Group)-2 method or other formats. Similarly, a JPEG (Joint Photographic Experts Group) codec unit 118 is one example of a still image codec that applies coding/decoding processing to still images. A coding/decoding format thereof may be JPEG 2000, PNG, or other formats. In the present embodiment, the JPEG codec unit 118 is connected to the video signal processing unit 115 to share circuits with the H.264 codec unit 117 and to realize a function of capturing a still image from reproduced moving images (capture function). However, the JPEG codec unit 118 may be connected directly to the camera signal processing unit 106. The fourth storage unit 119 is used for coding/decoding, that is to say, used by the H.264 codec unit 117 and the JPEG codec unit 118 in coding/decoding an image signal.

The recording/reproducing unit 120 records and reads recording data into and from a recording medium 121, the recording data having been processed into coded data or a recording format by the video signal processing unit 115 and the H.264 codec unit 117 or the JPEG codec unit 118. The recording medium 121 is not limited to a memory card; it may be a DVD or a larger-capacity optical disc, HDD, SSD, and the like, in which case a corresponding recording/reproducing system is separately configurable.

The first display unit 122 and the second display unit 123 are display apparatuses, and they can both display similar information. In the present embodiment, it is assumed that the second display unit 123 is smaller than the first display unit 122 and is provided inside a finder. On the other hand, the first display unit 122 is, for example, a relatively large display apparatus that is provided on a side surface of a housing and the like in an openable/closable manner.

In an image capture mode, these first and second display units 122 and 123 display not only an input image and an enlarged image from the image sensor 102, but also assistance such as an image capture aspect frame. The first and second display units 122 and 123 function as electronic viewfinders (EVFs) by sequentially displaying input images from the image sensor 102.

On the other hand, in a reproducing mode, the first and second display units 122 and 123 display moving images and still images recorded in the recording medium 121. They can also display, for example, information of operations input by the operator to the input operation unit 113, as well as arbitrary image information (image capture information) in the memory card representing the recording medium 121.

The analog line output unit 124 is a group of interfaces for output of an analog component image, S-video output, composite image output, and the like. For example, an image output from the present digital camera can be displayed on an external monitor by connecting the analog line output unit 124 to the external monitor.

The digital data I/F unit 125 can include one or more digital interfaces such as a USB, an SDI, and an HDMI (registered trademark).

Figure 2:
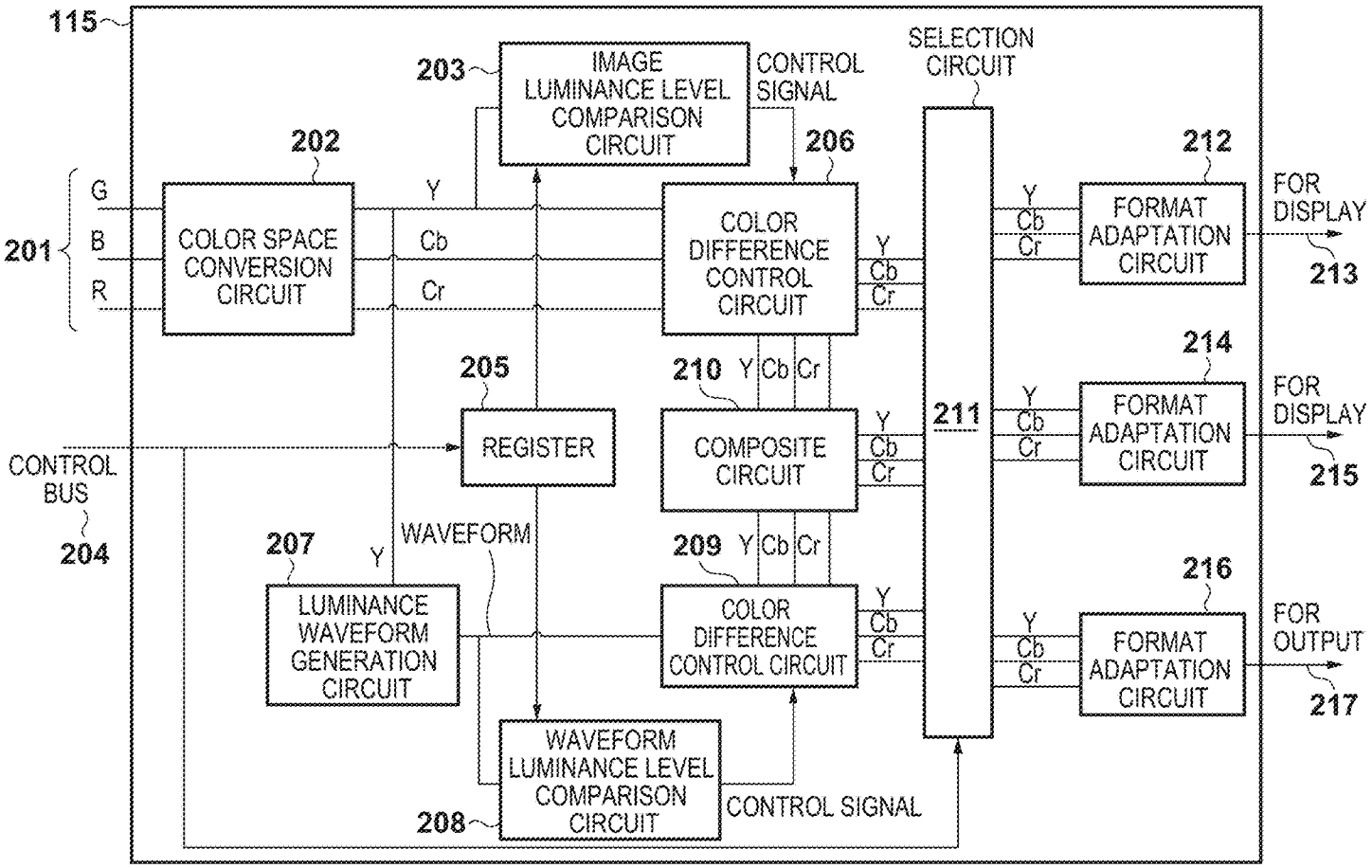
FIG. 2 is a block diagram showing an example of a functional configuration of a video signal processing unit 115 shown in FIG. 1.
Figure 3:
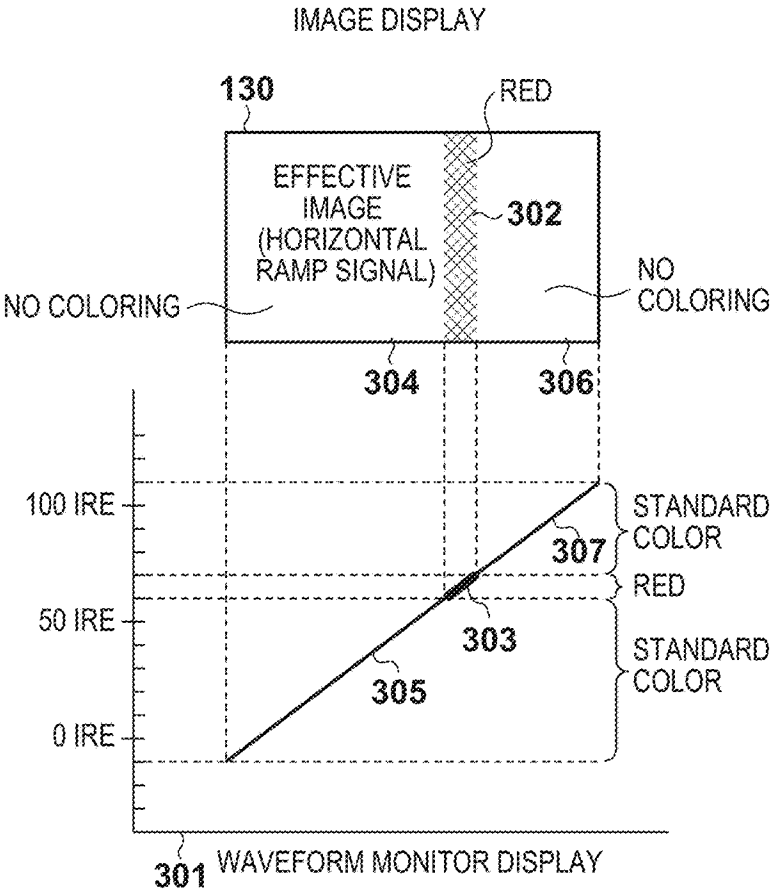
FIG. 3 schematically shows an example of image display and luminance waveform display on a digital camera according to a first embodiment of the present invention.

With reference to FIGS. 2 and 3, the following describes display of assistance for aiding the user in understanding a relationship between specific luminance levels and positions on an image screen on the digital camera according to the present embodiment, as well as a method for realizing such display.

FIG. 2 is a block diagram showing a part of a functional configuration of the video signal processing unit 115.

An input image signal 201 of an RGB format is supplied from the camera signal processing unit 106.

A color space conversion circuit 202 converts the input image signal 201 from an RGB color space to a YCbCr color space through 3×3 matrix calculation. A luminance (Y) component of the converted image signal (hereinafter referred to as a luminance signal) is input to an image luminance level comparison circuit 203, a color difference control circuit 206, and a luminance waveform generation circuit 207, whereas a color difference (Cb, Cr) component of the converted image signal (hereinafter referred to as a color difference signal) is input to the color difference control circuit 206.

The image luminance level comparison circuit 203 compares the luminance signal from the color space conversion circuit 202 with a luminance level range that has been preset in a register 205 by the system control unit 111 via a control bus 204, and notifies the color difference control circuit 206 of whether the luminance signal falls within or outside the range. Here, a plurality of luminance level ranges may be set in the register 205 for comparison.

If a plurality of luminance level ranges are set in the register 205, the image luminance level comparison circuit 203 notifies the color difference control circuit 206 of the result of determination in such a manner that a luminance level to which the result of determination pertains is discernible. This notification may be performed using any method; for example, this notification may include the result of determination together with information that makes a luminance level range identifiable on a pixel-by-pixel basis.

In accordance with the result of comparison by the image luminance level comparison circuit 203, the color difference control circuit 206 controls a color difference signal corresponding to a pixel position of the compared luminance signal. Specifically, the color difference control circuit 206 generates color differences such that pixels that fall within the set luminance level range are displayed in a color that has been preset for the luminance level range, whereas pixels that do not fall within the set luminance level range are displayed in original colors. The details will be described later.

For example, the luminance waveform generation circuit 207 generates a luminance waveform signal displayed by a general waveform monitor (WFM), and outputs the luminance waveform signal to a waveform luminance level comparison circuit 208 and a color difference control circuit 209. Specifically, it generates a luminance waveform signal for an image signal corresponding to one screen by generating luminance value waveforms for respective horizontal lines of an image, and compositing the luminance value waveforms corresponding to one screen. The luminance waveform signal represents a two-dimensional luminance waveform screen, an x-coordinate of each pixel represents a position in an image signal in a horizontal direction, a y-coordinate of each pixel represents a luminance value, and a pixel value represents the appearance frequency of luminance represented by the y-coordinate. Therefore, in a case where a vertical line of an image signal at a horizontal position x1 is composed of pixels with the same luminance value y1, on a luminance waveform screen, among a group of pixels whose x-coordinates are x1, only a pixel whose y-coordinate is y1 has a value and pixels with other y-coordinates do not have a value. Also, the higher the appearance frequency, the larger a pixel value of a luminance waveform screen, and therefore the higher the luminance of display.

The waveform luminance level comparison circuit 208 compares a luminance level represented by each pixel of luminance waveform data from the luminance waveform generation circuit 207 with the luminance level range preset in the register 205, and notifies the color difference control circuit 209 of whether the luminance level falls within or outside the range. It should be noted here that the "luminance level represented by a pixel" is not a value of the pixel (=appearance frequency), but is a value corresponding to a y-coordinate of the pixel on waveform monitor display.

If a plurality of luminance level ranges are set in the register 205, the waveform luminance level comparison circuit 208 notifies the color difference control circuit 209 of the result of determination in such a manner that a luminance level to which the result of determination pertains is discernible. This notification may be performed using any method; for example, this notification may include the result of determination together with information that makes a luminance level range identifiable on a pixel-by-pixel basis.

In accordance with the result of comparison by the waveform luminance level comparison circuit 208, the color difference control circuit 209 generates luminance and color difference signals corresponding to a pixel of the compared luminance waveform signal. This luminance increases as a pixel value increases. The color difference control circuit 209 also generates color differences such that pixels that fall within the set luminance level range are displayed in a color that has been preset for the luminance level range, whereas pixels that do not fall within the set luminance level range are displayed in a preset standard color.

A composite circuit 210 generates a composite image corresponding to one screen by compositing the luminance and color difference signals from the color difference control circuits 206 and 209. For example, the composite circuit 210 composites waveform display represented by a YCbCr (YUV) signal from the color difference control circuit 209 with an image represented by a YCbCr (YUV) signal from the color difference control circuit 206 such that the waveform display is in the form of a semi-transparent inset window or is in another area on the same screen.

A selection circuit 211 receives luminance and color difference signals from the color difference control circuit 206, the color difference control circuit 209, and the composite circuit 210, and outputs a signal selected in accordance with control by the system control unit 111 via the control bus 204 to format adaptation circuits 212, 214, 216.

The format adaptation circuit 212 outputs a display signal 213, which is obtained by converting an image signal received from the selection circuit 211 into a signal format for display on a liquid crystal panel of the first display unit 122, to the first display unit 122. It is assumed here that the image signal is converted into an LVDS transmission format.

The format adaptation circuit 214 outputs a display signal 215, which is obtained by converting an image signal received from the selection circuit 211 into a signal format for display on a liquid crystal panel of the second display unit 123, to the second display unit 123. It is assumed here that the image signal is converted into an LVDS transmission format similarly to the format adaptation circuit 212. As the first display unit 122 and the second display unit 123 have different display resolutions as stated earlier, the display signal 213 output to the first display unit 122 includes a larger number of pixels than the display signal 215 output to the second display unit 123. Other aspects may be similar to the first embodiment.

The format adaptation circuit 216 outputs an output signal 217, which is obtained by converting an image signal received from the selection circuit 211 into a signal format for external output, to the digital data I/F unit 125. It is assumed here that the image signal is converted into an SDI output format through conversion into a YCC (YUV) 422 format with compression of color differences (CbCr) relative to luminance (Y).

With reference to FIG. 3, the following schematically describes one example of a display control operation performed by the image signal processing circuits shown in FIG. 2.

It is assumed that an image and a luminance waveform (waveform monitor display) are both displayed on the first display unit 122 in FIG. 3. Also, for simplified explanation, it is assumed that an image signal is a horizontal ramp signal having low luminance on the left side of the screen and high luminance on the right side of the screen. That is to say, it is assumed that, in the image, pixels on the same vertical line have an equal luminance level, and the luminance of vertical lines constantly increases from left to right on the screen.

A waveform monitor display area 301 has a coordinate axis corresponding to an image display area 130 in a horizontal direction, and a vertical direction thereof represents a luminance level by IRE. In a case where the image display area 130 and the waveform monitor display area 301 are thus displayed in a positionally corresponding manner, the image display area 130 and the waveform monitor display area 301 are displayed on the same display unit. However, in a case where the positional correspondence is not displayed, they may be displayed on separate display units, and may be displayed on the same display unit. Here, IRE (Institute of Radio Engineers) is a unit that takes a 100% white luminance level of an image signal as 100 [IRE]. In the present embodiment, the brightness of waveform display represents the frequency of a luminance level in an image screen, and brighter display indicates a higher frequency of the luminance level at the same horizontal position (not shown).

Referring to the image signal shown in FIG. 3, an area 302 with a luminance level in a range of 60 IRE to 70 IRE is colored when displayed (here, red is used as one example). This coloring may be realized by the video signal processing unit 115 displaying, for example, a colored uniform pattern superimposed over an image, similarly to superimposition of a zebra pattern, and by replacing or converting a color of a target pixel in the image similarly to false color display.

With regard to luminance waveform display in the waveform monitor display area 301, an area 303 corresponding to the area 302 in the image is displayed in a color corresponding to the color applied to the area 302, e.g., the same color (red). The color applied to the image signal and the color applied to the luminance waveform display need not be exactly the same, and it is sufficient for them to be similar to the extent that their corresponding relationship can be understood without confusion with other colors applied to the image signal. Therefore, the expression "corresponding color" should be interpreted as including not only the same color but also similar colors.

Meanwhile, in areas 304, 306 of the image signal whose luminance levels fall outside the range of 60 IRE to 70 IRE, the image is displayed as-is because coloring is not applied.

Therefore, areas 305, 307 of the luminance waveform display corresponding to the areas 304, 306 are displayed in a preset standard color, e.g., green.

As described above, according to the present embodiment, an image signal is displayed together with a luminance waveform of the image signal. Also, a range (pixels) of the image signal with a particular luminance level is colored when displayed, and similarly to the image signal, a portion of luminance waveform display corresponding to the particular luminance level is also colored when displayed. Therefore, the user can understand the positions and the amount of pixels in a particular luminance level range in an image from a screen displaying the image, and the user can easily and correctly understand specific values of the particular luminance level range in image display from a screen displaying a luminance waveform. For example, if the present embodiment is applied to an image displayed as a live view, an intended image capture result can be obtained by setting exposure conditions while viewing the screen displaying the image and the screen displaying the luminance waveform.

Second Embodiment

A second embodiment of the present invention will now be described. The present embodiment differs from the first embodiment as follows: when displayed, an image is colored based on a plurality of luminance level ranges covering all luminance levels, instead of one luminance level range, and a luminance waveform is displayed in a corresponding manner.

Figure 4:
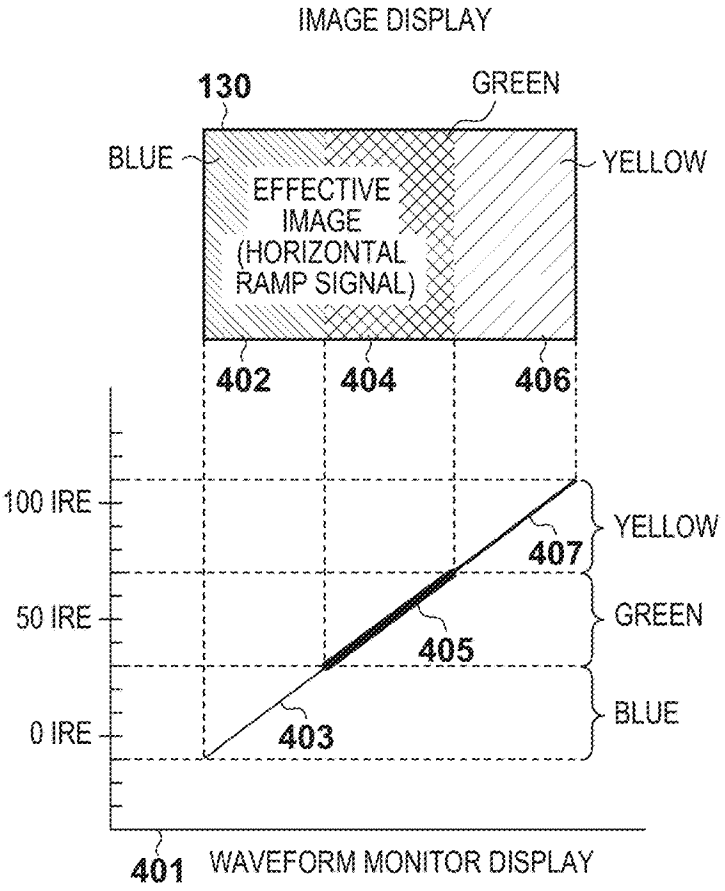
FIG. 4 schematically shows an example of image display and luminance waveform display on a digital camera according to a second embodiment of the present invention.

Basic operations are similar to those of the first embodiment, and therefore a description thereof will be omitted. FIG. 4 schematically shows a display method according to the present embodiment for an image similar to the image shown in FIG. 3.

In the present embodiment, a luminance level is divided into the following three luminance level ranges: a range of 30 IRE or less, displayed in blue; a range over 30 IRE and below 70 IRE, displayed in green; and a range of 70 IRE or more, displayed in yellow. Therefore, a luminance level of an image signal according to the present embodiment linearly increases from left to right, from 0 IRE or less to 100 IRE or more through 0 IRE and 100 IRE, and areas 402, 404 and 406 of an image display area 130 are displayed in blue, green, and yellow, respectively.

In this case, the video signal processing unit 115 also displays a luminance waveform in a waveform monitor display area 401 such that a portion 403 of 30 IRE or less is displayed in blue, a portion 405 of over 30 IRE and below 70 IRE is displayed in green, and a portion 407 of 70 IRE or more is displayed in yellow.

Modification Examples

Instead of allocating colors to all luminance levels, an image may be colored when displayed based on a plurality of luminance level ranges in a particular range, and a luminance waveform may be displayed in a corresponding manner.

Figure 5A:
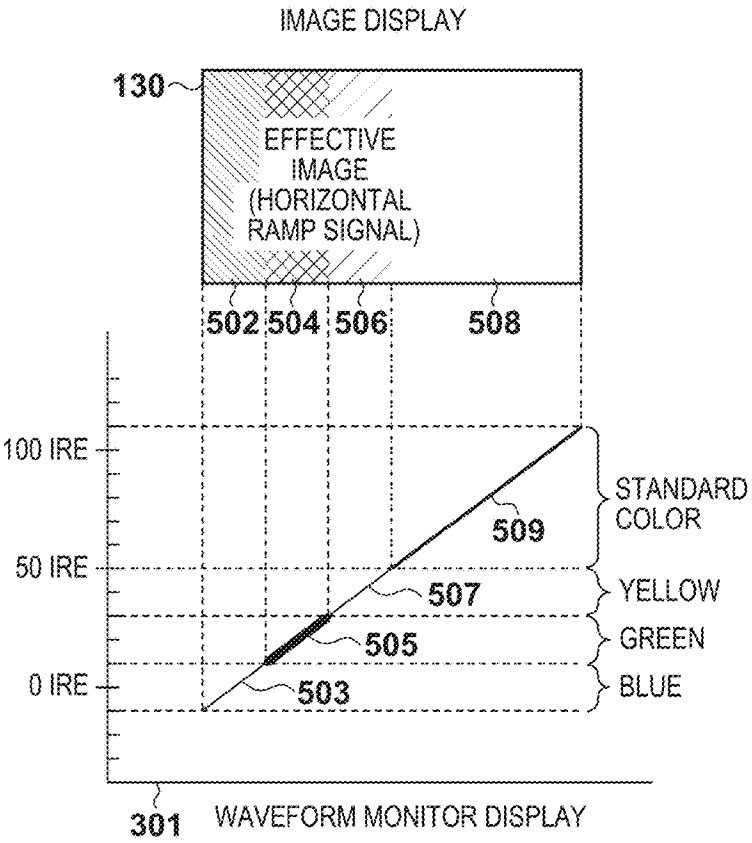
FIGS. 5A and 5B schematically show other examples of image display and luminance waveform display on a digital camera according to the second embodiment of the present invention.
Figure 5B:
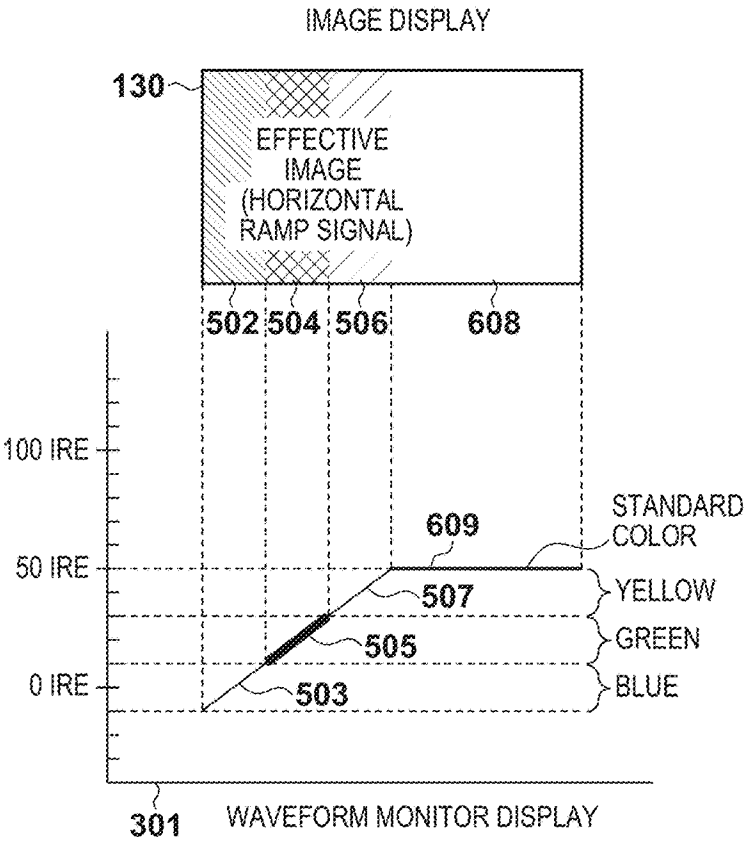

For example, FIGS. 5A and 5B show examples in which a luminance level of 50 IRE or less is divided into substantially equal luminance level ranges, and the divided luminance level ranges are displayed in different colors.

FIG. 5A shows an example in which a portion of an image signal (here, a horizontal ramp signal) whose luminance level is 50 IRE or less is divided into three luminance level ranges, the divided luminance level ranges are displayed in different colors, and similar coloring is applied to waveform monitor display. Such display control can be realized by the system control unit 111 controlling the luminance level ranges set in the register 205.

Therefore, areas 502, 504, 506 of an image display area 130 and areas 503, 505, 507 of a luminance waveform in a waveform monitor display area 301 are displayed in corresponding colors. In contrast, in an area 508 of over 50 IRE, the image signal is not colored when displayed, and the original image is displayed as-is; a corresponding area 509 of the luminance waveform is displayed in a standard color, e.g., green, which is different from the colors of the areas 503, 505, 507.

This is effective, for example, in confirming the balance of a low-illuminance portion in particular.

Also, it is possible to dynamically change luminance levels that are colored when displayed in accordance with a maximum luminance level of a displayed image signal. For example, as shown in FIG. 5B, in a case where a maximum luminance level of an image signal is 50 IRE, a range of luminance levels in the image signal (0 IRE to 50 IRE) may be divided into a plurality of ranges and colored when displayed. Such display control can be realized by the system control unit 111 controlling the luminance level ranges set in the register 205 in accordance with a maximum luminance level of the image detected by the camera signal processing unit 106. In this way, information appropriate for image capture conditions can be provided to the user.

FIG. 5B shows an example in which a portion with 50 IRE, i.e., the maximum luminance level is not colored when displayed, and a luminance range below 50 IRE is divided into three ranges that are colored when displayed. An area 608 with a luminance level of 50 IRE is not colored when displayed, and a corresponding area 609 of a luminance waveform is displayed in a standard color. In this case, a fluctuation in the maximum luminance level causes a change in the divided luminance ranges which are equal to or less than the maximum luminance level and to which particular colors are applied when displayed.

The present embodiment not only achieves the effects similar to those achieved by the first embodiment, but also enables understanding of the distribution and values of luminance levels in a plurality of luminance level ranges at once, as well as more precise exposure settings at the time of image capture.

While FIGS. 3 to 5B show exemplary cases in which horizontal positions in the luminance waveform display are aligned with horizontal positions in the image display, correspondence between the luminance waveform display and the image display can be clearly understood without aligning their display positions because coloring applied to the image corresponds to coloring applied to the luminance waveform display.

For example, it is possible to adopt a configuration in which a screen displaying a luminance waveform is displayed superimposed over a screen displaying an image in a picture-in-picture style (as an inset window).

Figure 6A:
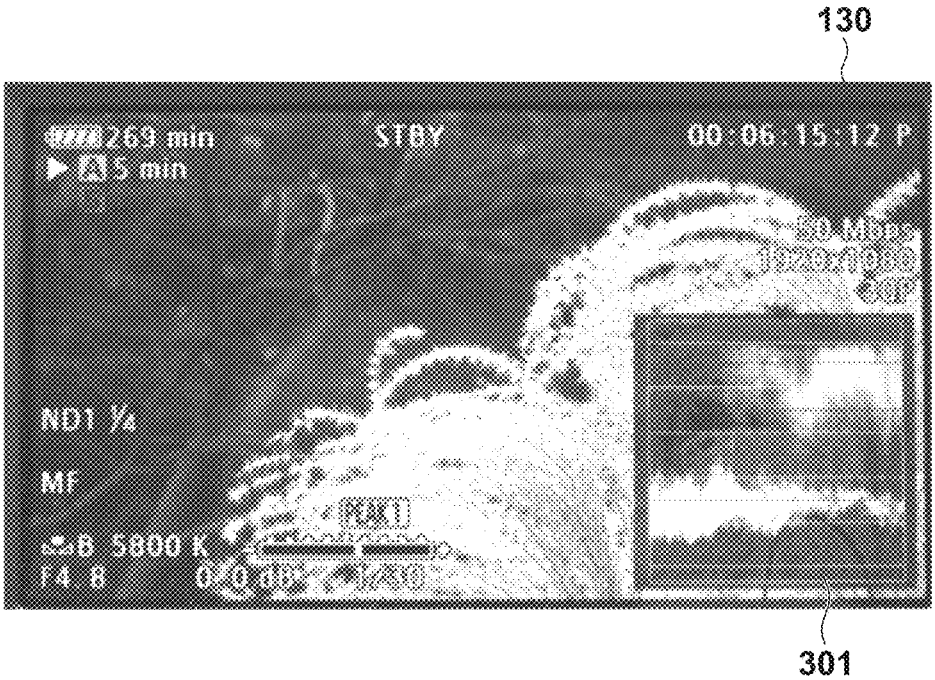
FIGS. 6A and 6B schematically show still other examples of image display and luminance waveform display on a digital camera according to an embodiment of the present invention.
Figure 6B:
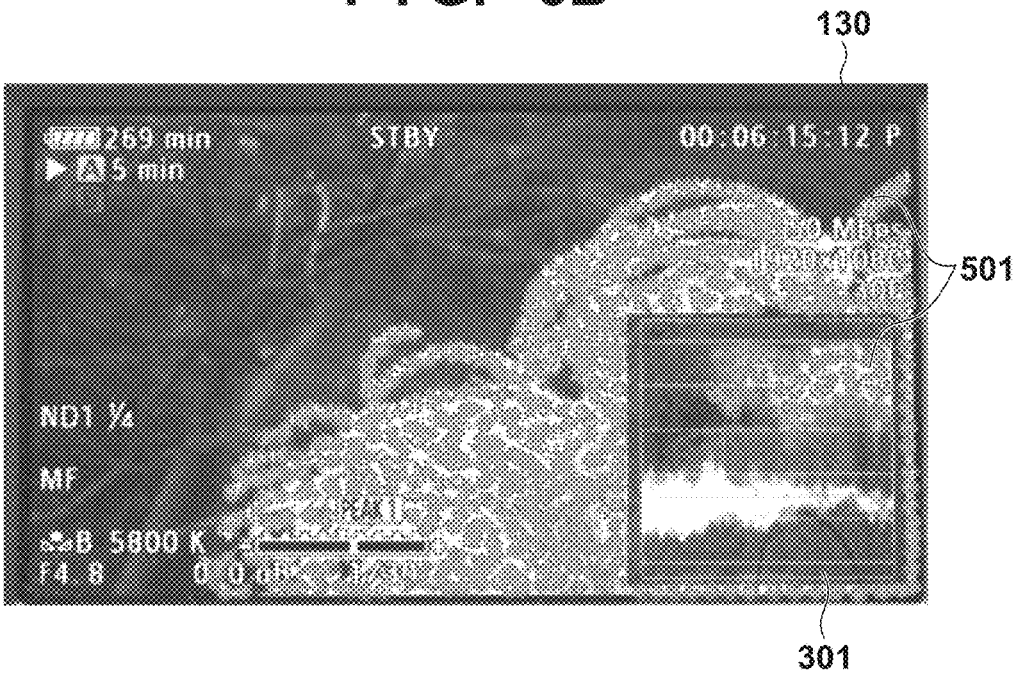

FIGS. 6A and 6B show examples in which a waveform monitor display area is displayed as an inset window superimposed over an image display area. FIG. 6A shows a state of display before coloring is applied, whereas FIG. 6B shows a state of display with coloring. In the present examples, a semi-transparent waveform monitor display area 301 is displayed superimposed over an image display area 130. As indicated by 501 of FIG. 6B, pixels with a predetermined luminance level in an image displayed in the image display area 130, as well as portions of the waveform monitor display area 301 corresponding to the predetermined luminance level, are displayed in corresponding colors. In a case where the waveform monitor display area 301 and the image display area 130 are thus displayed without aligning their positions, it is possible to adopt a configuration in which the waveform monitor display area 301 and the image display area 130 are displayed on different display units. Also, as long as the image and the luminance waveform can be compared with each other, it is possible to adopt a display configuration in which the waveform monitor display area 301 and the image display area 130 are alternately displayed on the same display screen, and a configuration in which the image display area 130 is always displayed and the waveform monitor display area 301 flashes when displayed.

Third Embodiment

A third embodiment of the present invention will now be described. As a functional configuration of a digital camera according to the present embodiment may be similar to those of the first and second embodiments, the following describes control operations for image display and waveform monitor display that are characteristic of the present embodiment.

The feature of the present embodiment is that a luminance level range for which colored display is performed is determined using a reference luminance level and a gamma correction curve (tone correction characteristics) applied to an image signal.

Figure 7:
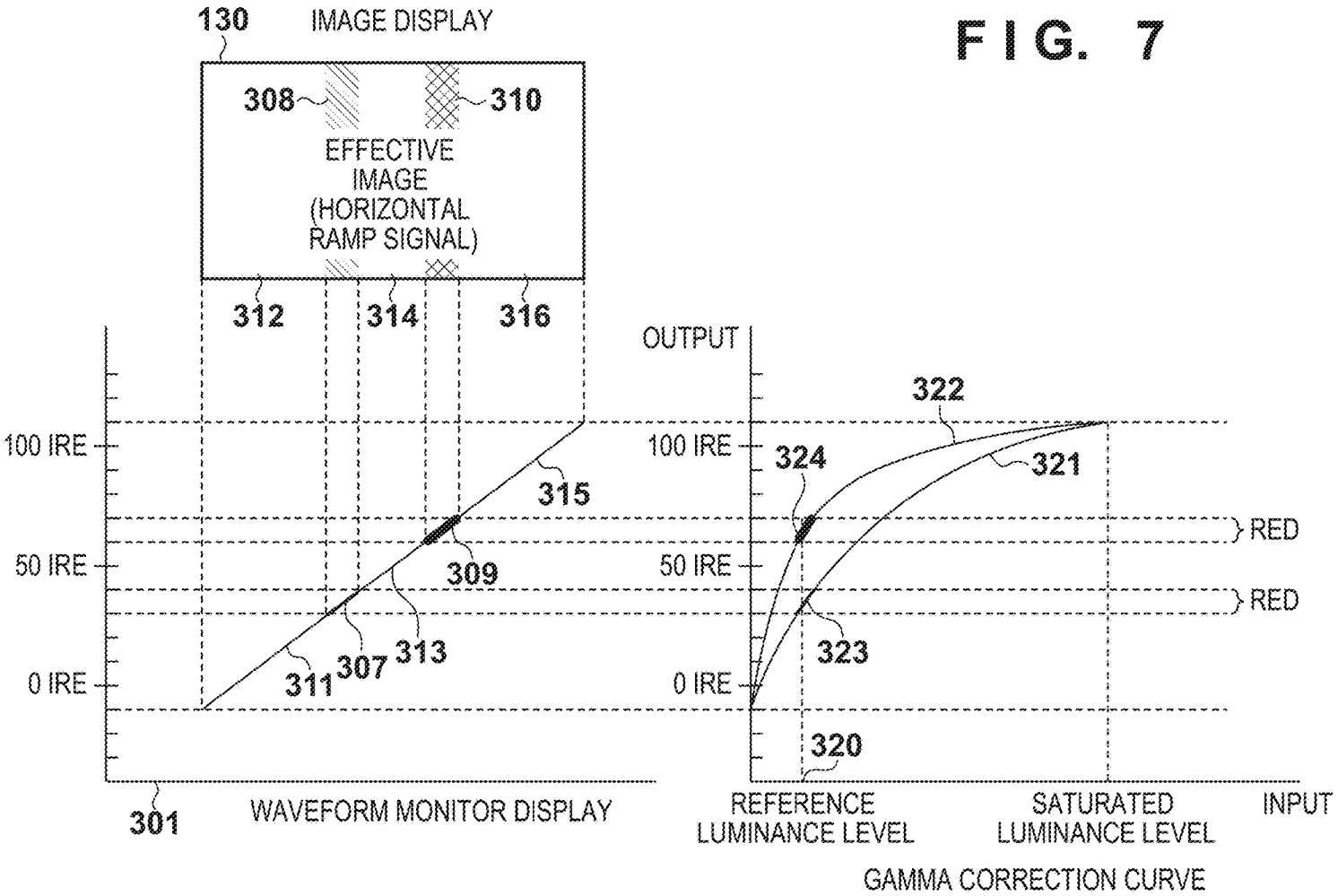
FIG. 7 schematically shows an example of image display and luminance waveform display on a digital camera according to a third embodiment of the present invention.

FIG. 7 shows an image display area 130 and a waveform monitor display area 301 in a format similar to those shown in FIGS. 3 and 4. It is also assumed here that an image signal is a horizontal ramp signal having low luminance on the left side of the screen and high luminance on the right side of the screen.

In television broadcasting of an NTSC method, a gamma value is defined as 2.2 in a television on the receiving end, and gamma correction is generally applied in the transmission end using a gamma value of 1/2.2=0.4545 . . . , which represents inverse gamma characteristics of a display apparatus, so as to realize display of linear tones. Gamma correction is tone correction processing using a gamma correction curve with nonlinear input/output characteristics. If gamma correction is performed using inverse gamma characteristics of a display apparatus (the first display unit 122) at the time of image capture, a luminance waveform of the horizontal ramp signal forms a straight line as shown in FIG. 7. In some cases, a gamma correction curve applied to the image signal at the time of image capture does not necessarily represent (match) inverse characteristics of a gamma curve of a display apparatus; in these cases, a luminance waveform is not always linear even if the image signal is a horizontal ramp signal.

In the present embodiment, it is assumed that a gamma correction curve A 321 and a gamma correction curve B 322 shown in FIG. 7 are used as gamma correction curves (tone correction characteristics) that could be applied by the camera signal processing unit 106 at the time of image capture. These curves are used to facilitate the explanation and understanding, and basic operations are similar also in a configuration in which one of three or more gamma correction curves is applied.

It is assumed here that a reference luminance level has been preset as information for designating a luminance level range for which colored display is performed. The reference luminance level is a particular luminance level [REI]. While a plurality of reference luminance levels may be set, it is assumed here that one reference luminance level is set to facilitate the explanation and understanding.

The system control unit 111 obtains information for identifying a gamma correction curve applied to the image signal from the camera signal processing unit 106. This information may be the gamma correction curve itself, and may be identification information of the gamma correction curve. Which one of the plurality of gamma correction curves should be applied may be determined in accordance with an arbitrary standard, for example, user settings. The system control unit 111 refers to a gamma correction curve to be used by obtaining the same from the camera signal processing unit 106 or by referring to a storage apparatus of its own, and obtains a luminance value resulting from application of the gamma correction curve to the reference luminance level (a gamma-corrected value). Then, the system control unit 111 obtains a predetermined luminance level range centering on the gamma-corrected value as a luminance level range for which colored display is performed, and sets the same in the register 205 of the video signal processing unit 115.

In the example shown in FIG. 7, a range that centers on a luminance value corrected (converted) using the gamma correction curve, with a tolerance of +5 [IRE] and −5 [IRE], is used as a luminance level range for which colored display is performed. As a result, a luminance level range 323 and a luminance level range 324 represent the luminance level range for which colored display is performed when the gamma correction curve A 321 and the gamma correction curve B 322 are applied to the reference luminance level 320, respectively.

Once the luminance level range has been set in the register 205, processing is similar to that of the first embodiment. Therefore, when the camera signal processing unit 106 uses the gamma correction curve A 321, an area 308 of the image display area 130 corresponding to the luminance level range 323, as well as a corresponding area 307 of the luminance waveform in the waveform monitor display area 301, is colored when displayed. On the other hand, when the camera signal processing unit 106 uses the gamma correction curve B 322, an area 310 of the image display area 130 corresponding to the luminance level range 324, as well as a corresponding area 309 of the luminance waveform in the waveform monitor display area 301, is colored when displayed.

In FIG. 7, a case in which the camera signal processing unit 106 uses the gamma correction curve A 321 is shown together with a case in which it uses the gamma correction curve B 322, and therefore the areas 308 and 310 (or the areas 307 and 309) look as if they are both colored when displayed. However, in practice, only one of the areas corresponding to the gamma correction curve is colored when displayed.

Whether the gamma correction curve A 321 or B 322 is used, areas 312, 314, 316 of the image display area 130 are not colored when displayed. Similarly, whether the gamma correction curve A 321 or B 322 is used, areas 311, 313, 315 of the luminance waveform in the waveform monitor display area 301 are displayed in a standard color.

The operation in which the system control unit 111 obtains a gamma-corrected reference luminance level and accordingly sets a luminance level range for which colored display is performed in the register 205 may be performed in the image luminance level comparison circuit 203 and the waveform luminance level comparison circuit 208. In this case, the system control unit 111 sets, for example, information for identifying a gamma correction curve that is applied by the camera signal processing unit 106 to the image signal and the reference luminance level in the register 205. Then, the image luminance level comparison circuit 203 and the waveform luminance level comparison circuit 208 obtain a reference luminance level to which the gamma correction curve has been applied, set a luminance level range to which coloring is applied, and execute level comparison processing. The reference luminance level to which the gamma correction curve has been applied may be obtained using a gamma correction curve obtained from the camera signal processing unit 106 or the system control unit 111, and using a gamma correction curve prestored in the video signal processing unit 115. It is possible to adopt a configuration in which one of the image luminance level comparison circuit 203 and the waveform luminance level comparison circuit 208 obtains a luminance level range and the other is notified of the same.

As described above, in the present embodiment, with the use of a reference luminance level before the gamma correction and a gamma correction curve (tone correction characteristics), a luminance level range corresponding to a reference luminance level after the gamma correction is colored when displayed. This makes it possible to not only achieve the effects of the first and second embodiments, but also set image capture conditions with attention to a luminance level suited for a gamma correction curve used in image capture in a case where, for example, an image capture luminance level is managed using a known input image such as an 18% gray chart. The present embodiment can also be combined with the second embodiment.

Other Embodiments

While the present invention has been described above in detail based on exemplary embodiments thereof, the present invention is by no means limited to these particular embodiments and includes various configurations in a scope that does not depart from the concept of the present invention. Parts of the above-described embodiments may be combined as appropriate.

Especially, a method of changing a color of an image by controlling color difference (Cb, Cr) components of the image may not be used to show association between a luminance level of the image and a luminance level of a waveform of a waveform monitor. Similar effects are achieved by alternatively superimposing an arbitrary pattern in a predetermined color corresponding to a luminance level range during display with respect to a target luminance level, the arbitrary pattern being, for example, a zebra pattern that is widely used conventionally. In this case, the image signal may be displayed in black and white.

The above-described colored display can be switched on or off at any timing. For example, the colored display may be switched on or off in accordance with an instruction through the input operation unit 113. To switch off the colored display, it is sufficient to stop the operations of at least the color difference control circuits 206, 209 such that the output of the color space conversion circuit 202 and the luminance waveform generation circuit 207 is input to the composite circuit 210 and the selection circuit 211. Regarding on and off of the colored display, management of a luminance level of an image obtained under new image capture conditions can be assisted by automatically switching on the colored display upon execution of an operation that causes a change in a luminance level of an image signal. Examples of such an operation include an operation of changing at least one of an f-number, a shutter speed, and image capture sensitivity, and an operation of changing an image capture mode and the like that results in a change in at least one of an f-number, a shutter speed, and image capture sensitivity. On and off of the colored display may be controlled based on other conditions.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-251415, filed on Dec. 4, 2013, which is hereby incorporated by reference herein its entirety.

What is claimed is:

1. An image signal processing apparatus that can display an image signal and a luminance waveform corresponding to the image signal, on a display unit, the image signal processing apparatus comprising:

at least one processor; and a memory that stores a program executable by the at least one processor, wherein the program, when executed by the at least one processor, causes the at least one processor to function as a display control unit that:

displays the image signal on the display unit so that a first area in the image signal, whose luminance level falls within a preset luminance level range, is displayed in a predetermined color, and displays the luminance waveform on the display unit so that a second area in the luminance waveform, which corresponds to the preset luminance level range, is displayed in a color corresponding to the predetermined color, wherein the luminance waveform represents an appearance frequency of each luminance level of the image signal at respective positions in horizontal or vertical direction of the image signal, wherein the processor sets the preset luminance level range in accordance with characteristics of a gamma curve that is applied to the image signal and based on a luminance level obtained by applying the gamma curve to a preset reference luminance level, and wherein the display control unit is capable of switching whether to perform the displaying in a color corresponding to the predetermined color in the second area of the luminance waveform.

2. The image signal processing apparatus according to claim 1, wherein the display control unit controls displaying the image signal and the luminance waveform so that a pattern, which has the predetermined color or the color corresponding to the predetermined color, is superimposed over the first area or the second area.

3. The image signal processing apparatus according to claim 1, wherein the display control unit controls displaying the image signal and the luminance waveform so that a signal of the first area or the second area is replaced with a signal, which has the predetermined color or the color corresponding to the predetermined color.

4. The image signal processing apparatus according to claim 1, wherein the display control unit controls displaying the luminance waveform so that the image signal and the luminance waveform are displayed in separate areas within a display area.

5. The image signal processing apparatus according to claim 4, wherein the display control unit controls displaying the luminance waveform so that the second area is displayed at a position corresponding to a position of the first area in the image signal within the display area.

6. The image signal processing apparatus according to claim 1, wherein the display control unit controls displaying the image signal and the luminance waveform so that the luminance waveform is superimposed as an inset window over a window in which the image signal is displayed.

7. The image signal processing apparatus according to claim 1, wherein the color corresponding to the predetermined color is one of the predetermined color and similar colors.

8. The image signal processing apparatus according to claim 1, wherein the preset luminance level range is set in accordance with characteristics of a gamma curve that is applied to the image signal.

9. The image signal processing apparatus according to claim 8, wherein when a number of the preset luminance level ranges are set, the display control unit controls displaying the image signal and the luminance waveform so that the first areas and the second areas are displayed in different colors for the preset luminance level ranges, respectively.

10. The image signal processing apparatus according to claim 9, wherein the plurality of the preset luminance level ranges are set based on a maximum luminance level of the image signal.

11. The image signal processing apparatus according to claim 9, wherein the plurality of the preset luminance level ranges are set based on a range of luminance levels included in the image signal.

12. The image signal processing apparatus according to claim 1, wherein the luminance waveform is generated by generating luminance value waveforms for respective horizontal lines of the image signal, and compositing the luminance value waveforms.

13. The image signal processing apparatus according to claim 1, wherein the luminance waveform is a two-dimensional waveform, and wherein an x-coordinate of the luminance waveform represents a position in the horizontal direction of the image signal, and a y-coordinate of the luminance waveform represents a luminance level.

14. The image signal processing apparatus according to claim 1, wherein a brightness of the luminance waveform at each coordinate represents the appearance frequency of a corresponding luminance level of the image signal at a corresponding position in the horizontal direction of the image signal.

15. An electronic device with an image capture function, the electronic device comprising:

at least one processor; and a memory that stores a program executable by the at least one processor, wherein the program, when executed by the at least one processor, causes the at least one processor to function as:

an image capture unit that generates an image signal;

an image signal processing apparatus that can display an image signal and a luminance waveform corresponding to the image signal, on a display unit, wherein the luminance waveform represents an appearance frequency of each luminance level of the image signal at respective positions in horizontal or vertical direction of; and a display control unit that displays the image signal on the display unit so that a first area in the image signal, whose luminance level falls within a preset luminance level range, is displayed in a predetermined color, and displays the luminance waveform on the display unit so that a second area in the luminance waveform, which corresponds to the preset luminance level range, is displayed in a color corresponding to the predetermined color, wherein the processor sets the preset luminance level range in accordance with characteristics of a gamma curve that is applied to the image signal and based on a luminance level obtained by applying the gamma curve to a preset reference luminance level, and wherein the display control unit is capable of switching whether to perform the displaying in a color corresponding to the predetermined color in the second area of the luminance waveform.

16. A control method for an image signal processing apparatus that can display an image signal and a luminance waveform corresponding to the image signal, on a display unit, the control method comprising:

displaying the luminance waveform on the display unit so that a first area in the image signal, whose luminance level falls within a preset luminance level range, is displayed in a predetermined color; and displaying the luminance waveform on the display unit so that a second area in the luminance waveform, which corresponds to the preset luminance level range, is displayed in a color corresponding to the predetermined color, wherein the luminance waveform represents an appearance frequency of each luminance level of the image signal at respective positions in horizontal or vertical direction of the image signal, wherein the preset luminance level range is set in accordance with characteristics of a gamma curve that is applied to the image signal and based on a luminance level obtained by applying the gamma curve to a preset reference luminance level, and wherein whether to perform the displaying in a color corresponding to the predetermined color in the second area of the luminance waveform is switchable.

17. The control method for an image signal processing apparatus according to claim 16, wherein the color corresponding to the predetermined color is one of the predetermined color and a similar color.

18. A non-transitory computer-readable storage medium having stored therein a program for causing a computer to function as an image signal processing apparatus that can display an image signal and a luminance waveform corresponding to the image signal, on a display unit, the image signal processing apparatus comprising:

a display control unit that displays the image signal on the display unit so that a first area in the image signal, whose luminance level falls within a preset luminance level range, is displayed in a predetermined color, and displays the luminance waveform on the display unit so that a second area in the luminance waveform, which corresponds to the preset luminance level range, is displayed in a color corresponding to the predetermined color, wherein the luminance waveform represents an appearance frequency of each luminance level of the image signal at respective positions in horizontal or vertical direction of the image signal, wherein the preset luminance level range is set in accordance with characteristics of a gamma curve that is applied to the image signal and based on a luminance level obtained by applying the gamma curve to a preset reference luminance level, and wherein the display control unit is capable of switching whether to perform the displaying in a color corresponding to the predetermined color in the second area of the luminance waveform.

* * * * *